US006237512B1

(12) United States Patent
Inoue

(10) Patent No.: US 6,237,512 B1
(45) Date of Patent: May 29, 2001

(54) WASTE LIQUID INCINERATOR AND METHOD OF INCINERATING WASTE LIQUID

(75) Inventor: Einosuke Inoue, Ina-machi (JP)

(73) Assignee: Kiyoshi Nakato, Atlanta, GA (US)

( * ) Notice: Subject to any disclaimer, the term of this patent is extended or adjusted under 35 U.S.C. 154(b) by 0 days.

(21) Appl. No.: 09/185,463

(22) Filed: Nov. 3, 1998

(30) Foreign Application Priority Data

Feb. 3, 1998 (JP) ..... 10-021854

(51) Int. Cl.[7] ..... F23G 7/04; F23C 5/32

(52) U.S. Cl. ..... 110/346; 110/233; 110/238; 431/5; 431/173; 431/278; 431/346

(58) Field of Search ..... 110/190, 235, 110/237, 238, 240, 241, 242, 346, 262, 233, 264, 265; 431/5, 202, 173, 4, 278, 346

(56) References Cited

U.S. PATENT DOCUMENTS

| | | | | |
|---|---|---|---|---|
| 478,980 | * | 7/1892 | Blackman | 110/238 |
| 1,530,321 | * | 3/1925 | Pollock | 431/173 X |
| 2,808,011 | * | 10/1957 | Miller et al. | 110/238 |
| 3,195,608 | * | 7/1965 | Voorheis et al. | 431/5 X |
| 3,362,359 | * | 1/1968 | Kells et al. | 110/238 |
| 3,583,339 | * | 6/1971 | Kube | 110/238 X |
| 3,597,141 | * | 8/1971 | Fracke | 110/264 X |
| 3,718,102 | * | 2/1973 | Hemsath et al. | 110/238 |
| 3,748,081 | * | 7/1973 | Hummell | 110/238 X |
| 3,828,700 | * | 8/1974 | Ragot | 431/5 X |
| 3,837,813 | * | 9/1974 | Ebeling et al. | 431/5 X |
| 3,885,906 | * | 5/1975 | Shurygin et al. | 110/238 X |
| 3,887,324 | * | 6/1975 | Reed et al. | 431/202 X |

(List continued on next page.)

FOREIGN PATENT DOCUMENTS

| | | | | |
|---|---|---|---|---|
| 1 269 918 | * | 6/1990 | (CA) | 110/238 |
| 2 337 283 | * | 2/1974 | (DE) | 431/202 |
| 38 06 379 A1 | * | 8/1989 | (DE) | 431/5 |
| 81 05886 | * | 10/1982 | (FR) | 110/190 |
| 1 353 613 | * | 5/1974 | (GB) | 110/238 |
| 1 441 748 | * | 7/1976 | (GB) | 110/238 |
| 53-100675 | * | 9/1978 | (JP) | 110/238 |
| 55-92810 | * | 7/1980 | (JP) | 110/238 |
| 56-71710 | * | 6/1981 | (JP) | 110/238 |
| 56-87716 | * | 7/1981 | (JP) | 110/238 |
| 4-283309 | | 10/1992 | (JP) . | |
| 920323 | * | 4/1982 | (SU) | 431/5 |
| 974039 | * | 11/1982 | (SU) | 110/238 |

OTHER PUBLICATIONS

Brochure titled "The BSP Multiple Hearth Furnace" by BSP Thermal Systems Inc. (Jul. 28, 1998).

Newsletter titled "Seghers better technology News" by Seghers Better Technology Group (Jul. 1998).

*Primary Examiner*—James C. Yeung
*Assistant Examiner*—Ljiljana V. Ciric

(57) ABSTRACT

An incinerator for waste liquid comprises a container, a burner and an atomizer. An incineration chamber is defined inside the container. The incineration chamber has upper and lower sections, and the container has a vent adjacent to the upper section of the chamber. The burner is connected to the container near the lower section to jet flame into the chamber. The atomizer is connected to the container near the lower section to shoot atomized waste liquid upwardly into the chamber such that waste liquid shot out of the atomizer is directed toward the upper section.

A method of incinerating waste liquid comprises the steps of jetting flame into the lower section of an incineration chamber having a vent adjacent to the upper section thereof, and shooting an atomized waste liquid upwardly into the lower section so that the atomized waste liquid is directed toward the upper section.

9 Claims, 4 Drawing Sheets

U.S. PATENT DOCUMENTS

| | | | | |
|---|---|---|---|---|
| 3,901,644 | * | 8/1975 | Armas | 431/4 X |
| 3,985,494 | * | 10/1976 | Childree | 431/5 X |
| 4,166,421 | * | 9/1979 | Stribling | 110/187 |
| 4,218,426 | * | 8/1980 | Dahmen | 431/173 X |
| 4,475,466 | * | 10/1984 | Gravely | 110/238 X |
| 4,802,423 | * | 2/1989 | Pennington | 431/5 X |
| 5,216,968 | * | 6/1993 | Capek et al. | 110/238 X |
| 5,295,817 | * | 3/1994 | Young | 431/202 X |
| 5,484,279 | * | 1/1996 | Vonasek | 110/238 X |
| 5,527,984 | * | 6/1996 | Stultz et al. | 431/5 X |
| 5,601,040 | * | 2/1997 | McGill | 110/238 X |
| 5,607,654 | | 3/1997 | Lerner | 423/240 |
| 5,632,211 | | 5/1997 | Okuno et al. | 110/235 |
| 5,634,413 | | 6/1997 | Listner et al. | 110/238 |
| 5,649,325 | | 7/1997 | Garrison et al. | 588/202 |
| 5,671,687 | | 9/1997 | Chen | 110/212 |
| 5,678,498 | | 10/1997 | Whaley | 110/345 |
| 5,722,333 | | 3/1998 | Hyun | 110/247 |
| 5,724,901 | | 3/1998 | Guy et al. | 110/346 |
| 5,727,483 | | 3/1998 | Chen et al. | 110/246 |
| 5,732,362 | | 3/1998 | Izumida et al. | 588/2 |
| 5,743,196 | | 4/1998 | Beryozkin et al. | 110/240 |
| 5,744,037 | | 4/1998 | Fujimura et al. | 210/620 |

* cited by examiner

WASTE LIQUID INCINERATOR AND METHOD OF INCINERATING WASTE LIQUID

BACKGROUND OF THE INVENTION

This invention relates generally to a device for incinerating waste water or waste solution (which water or solution will hereinafter be referred to as "waste liquid"), and more particularly to a waste liquid incinerator capable of efficiently incinerating both waste liquid and waste gas or waste air at the same time. The invention also relates to a method of incinerating waste liquid. A typical waste liquid useful in the invention contains a gas such as ethylene oxide. A typical waste gas useful in the invention is ethylene oxide. Waste air useful in the invention is that containing a malodorous substance such as an unsaturated organic compound.

A great amount of ethylene oxide has been used for the disinfection and sterilization of medical equipment. Used ethylene oxide is treated typically as a waste gas and thus is incinerated. Beside this, ethylene oxide, as being water soluble, tends to be present in a dissolved form in the water within transportation means such as a water seal pump. It is common that such water with dissolved ethylene oxide is stored and eventually incinerated as a waste liquid. Known as devices for incinerating waste liquid are vertical and horizontal incinerators.

A typical horizontal incinerator has a container including a horizontal tubular side wall and a pair of opposing end walls closing the opposite ends of the side wall. One of the end walls is provided with a burner, and the other end wall is with an inlet for waste liquid. The burner flame is jetted horizontally into the container toward the other end wall while waste liquid is sprayed downwardly from the inlet, which allows the sprayed waste liquid to be incinerated. In this type of incinerator, however, waste liquid is sprayed exclusively over the area remote from the burner flame in order to avoid the flame extinction due to the sprayed waste liquid.

Because of the above arrangement, the horizontal incinerators have the following drawbacks: (1) the internal temperature of the container tends to decrease to the extent that it is hard to carry out the complete incineration; (2) it is difficult to design a small-sized container; (3) a large installation space is required; (4) the equipment cost is high; (5) the heat efficiency is low which results in high energy consumption; and (6) a large amount of nitrogen oxide tends to be generated due to a high flame temperature, which may be a cause of photochemical smog, an environmental pollutant, when released into the atmosphere.

A typical vertical incinerator has a container including an upright tubular side wall and top and bottom opposed walls closing the upper and lower ends of the side wall. The side wall is provided at its midriff with a burner, and the top wall is with a waste liquid inlet. This arrangement is disclosed, for example, in Japanese Patent Application Laid-Open No. 4-283309. The burner flame is jetted horizontally into the container while waste liquid is sprayed downwardly from the inlet, resulting in the incineration of the sprayed waste liquid. In this incinerator, waste liquid is again sprayed over the area remote from the burner flame to avoid the extinction of the flame. Because of the arrangement similar to the horizontal incinerators, the vertical incinerators cannot be free of those similar to the above drawbacks (1)–(6).

What is needed, therefore, are an improved incinerator for waste liquid and an improved method of incinerating waste liquid. Such an incinerator and a method should provide better heat efficiency to allow the design of a small-sized incineration container, allow quick heating and rapid vaporization of waste liquid to encourage the complete incineration of the waste liquid, enable the incineration of a large amount of waste liquid in its smallsized container so that a less installation space is required, reduce the equipment cost, reduce the energy consumption while providing dependable heat efficiency and assure a low flame temperature to inhibit formation of nitrogen oxide.

SUMMARY OF THE INVENTION

According to the invention in one form, a waste liquid-incinerating device is provided. The device includes a container defining an incineration chamber, a burner for jetting flame into the chamber, and an atomizer for shooting atomized waste liquid upwardly into the chamber. Both the burner and the atomizer are connected to the container near the lower section of the chamber. The container has a vent adjacent to the upper section of the chamber. The waste liquid sprayed by the atomizer is directed toward the upper section.

In a preferred embodiment, the container comprises an upright tubular side wall having a cylindrical inside surface defining the incineration chamber. In this embodiment, the burner is held by the side wall and is disposed such that flame is jetted out of the burner in the direction along a horizontal line tangent to the inside surface of the side wall. The burner may comprise a tubular burner nozzle which is directed such that the tube axis of the burner nozzle is disposed substantially horizontally and out of alignment with any radial line of the cylindrical inside surface. The container may further comprise a bottom wall at the lower end of the side wall, and the atomizer may comprise an upwardly directed spray nozzle held by the bottom wall. Such a spray nozzle may be directed such that the tube axis of the spray nozzle is disposed substantially vertically and in general alignment with the cylinder axis defined by said cylindrical inside surface. The container may further comprise a top wall at the upper end of the side wall, and the vent may be defined in the top wall.

In another preferred embodiment, the device further comprises a first source for supplying a combustion-improving gas to the burner, a second source for supplying a waste liquid to the atomizer and a third source for supplying combustion air to the burner.

In a further preferred embodiment, the device further comprises a fourth source for supplying a waste gas or waste air to the device.

In a further preferred embodiment, the device further comprises a temperature sensor for detecting the temperature of the chamber. A suitable control device may be used in the incinerating device to control the intensity of the burner flame in response to the temperature information provided by the temperature sensor.

According to the invention in another form, a incinerating device is provided which comprises a container, burner means and atomizing means. The container includes an upright tubular side wall having a cylindrical inside surface and top and bottom walls. The upper wall is provided with a vent. The burner means is held by the side wall to jet flame into the container in the direction along a horizontal line tangent to the inside surface of the side wall. The atomizing means is held by the bottom wall to shoot atomized waste liquid upwardly into the container.

In a preferred embodiment of the second form, the burner means comprises a tubular burner nozzle. The burner nozzle is directed such that the tube axis of the burner nozzle is disposed substantially horizontally and out of alignment with any radial line of the cylindrical inside surface.

In another preferred embodiment, the atomizing means comprises an upwardly directed tubular spray nozzle. The spray nozzle is positioned such that the tube axis of the spray nozzle is disposed substantially vertically and in general alignment with the cylinder axis defined by the cylindrical inside surface.

The present invention further provides a method of incinerating waste liquid. The method comprises the steps of jetting flame into the lower section of an incineration chamber having a vent adjacent to the upper section thereof, and shooting an atomized waste liquid upwardly into the lower section so that the jetted atomized waste liquid is directed toward the upper section.

In a preferred embodiment, the chamber is defined by an upright cylindrical inside surface of a container, and the jetting step comprises jetting the flame in the direction along a horizontal line tangent to the inside surface. The method may further comprises the step of guiding the jetted flame along the inside surface of the container so that the flame surrounds the cylinder axis of the cylindrical inside surface. The shooting step may comprise directing at least some of the atomized waste liquid upwardly along the cylinder axis so that some of the atomized waste liquid drives through the surrounding flame. The guiding step may comprise guiding the flame circumferentially along the inside surface while attracting the flame toward the vent so that the flame climbs the container along a helical path on the inside surface and forms within the chamber a vortex of flame around a vertical axis. The vertical axis of the vortex may be generally coincidental with the cylinder axis, and the shooting step comprises directing at least some of the atomized waste liquid upwardly along the cylinder axis so that some of the atomized waste liquid drives through the center of the vortex.

In another preferred embodiment, the jetting step comprises mixing a waste gas with a combustion-improving gas and burning the mixed gas to form the flame. A preferred waste gas is ethylene oxide; however, other waste gas may be used with the invention. A preferred combustion-improving gas is a self-sustained combustion gas such as propane or other town gas. The waste liquid useful with the invention may be any liquid that can be incinerated and it includes, but not limited to, water containing ethylene oxide having been used for the disinfection and sterilization of medical equipment.

Other objects and advantages of the present invention will be apparent from the following description, the accompanying drawings and the appended claims.

DETAILED DESCRIPTION OF THE PREFERRED EMBODIMENT

Figure 2:
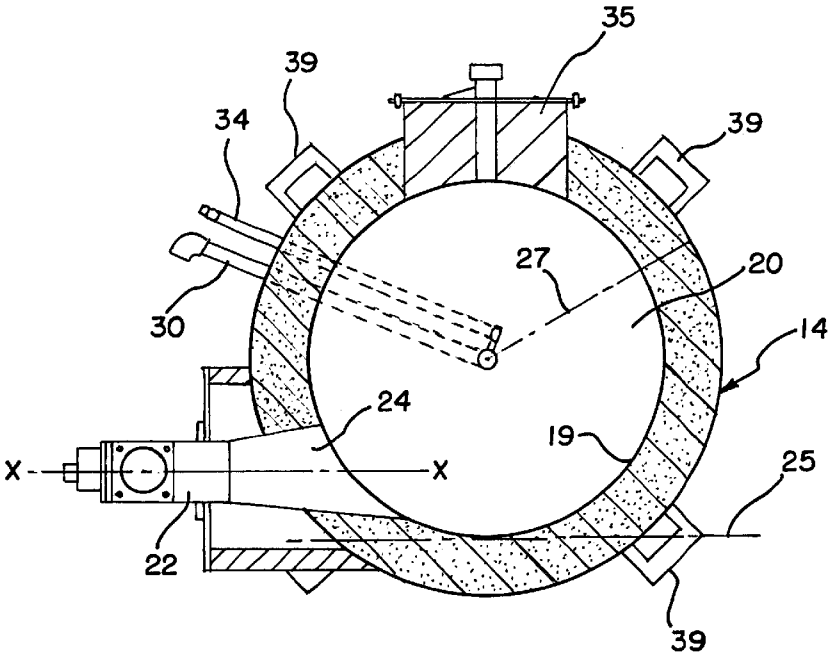
FIG. 2 is a view taken along the line II—II in FIG. 1.
Figure 1:
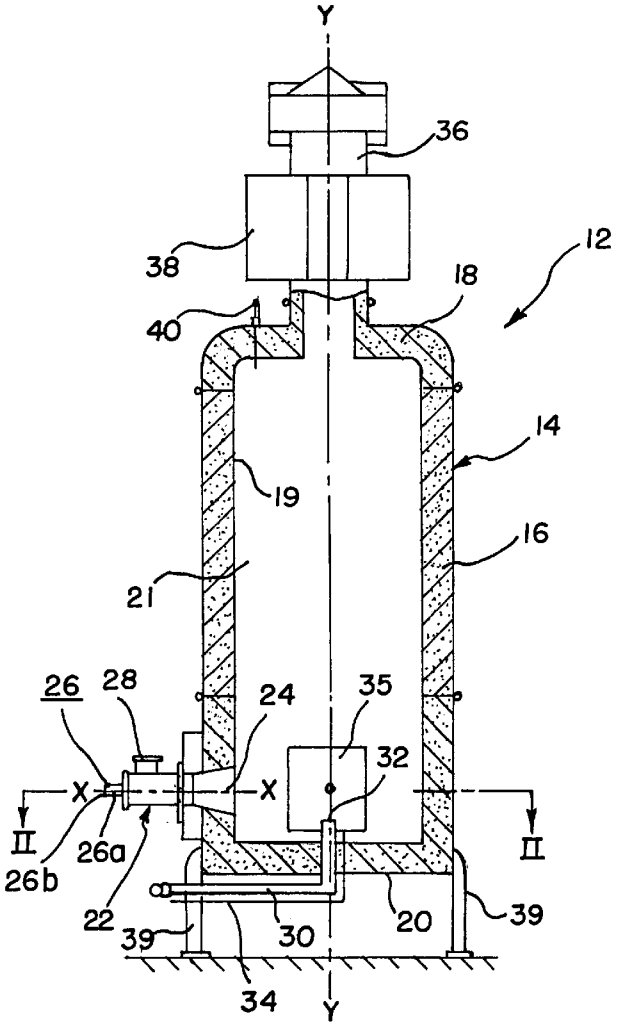
FIG. 1 is a schematic vertical cross section of a waste liquid incinerating device according to the present invention.

FIGS. 1 and 2 illustrate a vertical incinerator according to the invention. The incinerator, designated by reference numeral 12, is designed for incinerating a waste liquid such as a water solution of a combustible gas as well as for incinerating a combustible waste gas. The incinerator 12 has a vertically elongate container 14 including an upright tubular side wall 16, a top wall 18 and a bottom wall 20. The top wall 18 is joined to the upper end of the side wall 16 to partially close the upper end while the bottom wall 18 is joined to the lower end of the side wall 16 to close the lower end. The side wall 16 has an upright cylindrical inside surface 19. Defined by the walls 16, 18 and 20 is an incineration chamber 21 where the waste liquid is incinerated.

A burner 22 is connected to the container 14 to shoot flame into the lower/combustion section of the chamber 21. The burner 22 includes a nozzle 24 passing through the side wall 16 near the bottom wall 20 and held by the same. The nozzle 24 is directed inwardly of the container 14 such that the tube axis X—X (shown in FIG. 2) of the nozzle 24 is disposed generally horizontally and out of alignment with any radial line, such as at reference numeral 27, of the side wall 16. Stated differently, the tube axis X—X is parallel to a horizontal line 25 (shown in FIG. 2) tangent to that portion of the inside surface 19 adjacent to the nozzle 24. The top wall 18 is provided with a vent pipe 36. Thus, the flame jetted out of the nozzle 24 is attracted toward the vent pipe 36 while guided by and extending circumferentially along the cylindrical inside surface 19. This causes the flame to climb the side wall 16 along a helical path on the inside surface 19, which results in formation, within the chamber 21, of a vortex of flame around a vertical axis that is generally coincidental with the cylinder axis Y—Y (shown in FIG. 1) of the side wall 16.

Figure 3:
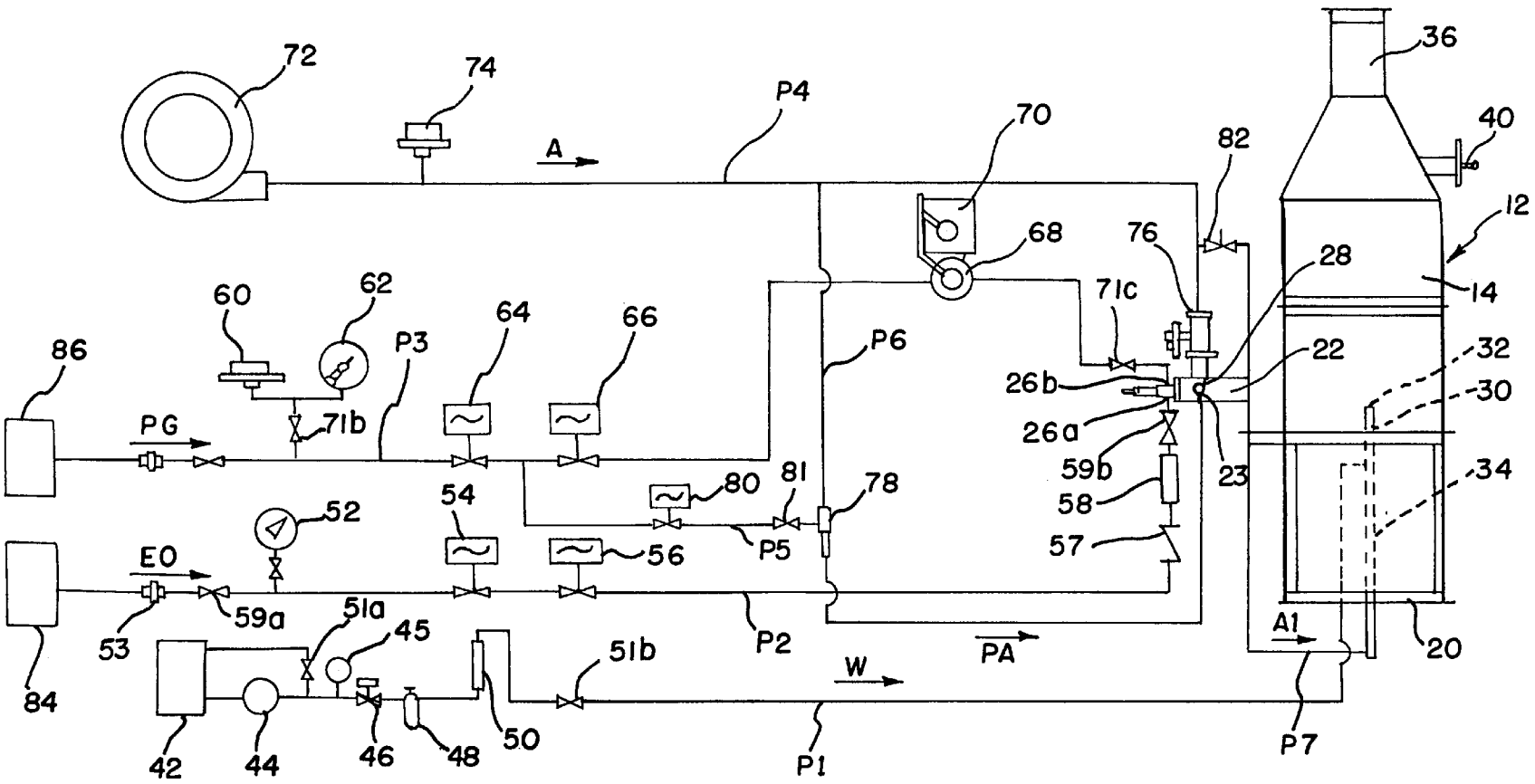
FIG. 3 is a schematic system diagram of the device in FIG. 1, showing the supply lines for and the flow directions of the waste liquid, the gases and the combustion air, fed from the respective supply sources.

The burner 22 has a fuel inlet tube 26 as well as a combustion air inlet 28. The inlet tube 26 is formed with both a waste gas inlet **26*a* and a combustion-improving gas inlet 26*b*. As shown in FIG. 3, the burner 22 is connected to a waste gas supply source 84, a combustion-improving gas supply source 86 and a combustion air supply source 72 through supply lines P2, P3 and P4 respectively so that the inlets 26*a*, 26*b* and 28 are in fluid communication respectively with the supply sources 84, 86 and 72**.

An atomizer pipe 30 is connected to the container 14 to shoot a waste liquid into the chamber 21. As best shown in FIG. 1, the atomizer pipe 30 has an upwardly directed spray nozzle 32 passing through the center of the bottom wall 20 and held by the same. The tube axis of the spray nozzle 32 is disposed substantially vertically and in general alignment with the cylinder axis Y—Y. Thus, at least some of the waste liquid jetted out of the spray nozzle 32 is directed upwardly along the cylinder axis Y—Y so that it drives through the vortex of flame formed within the chamber 21.

As best shown in FIG. 2, a protection air supply pipe 34 is disposed alongside the atomizer pipe 30. The forward end of the supply pipe 34 extends inwardly of the container 14 through the bottom wall 20 and is directed to the spray nozzle 32. This allows the air from the supply pipe 34 to blow on the spray nozzle 32 so that the spray nozzle 32 is cooled and thereby prevented from being excessively heated. A door 35 is movably connected to the side wall 16 to cover a manhole in the side wall 16. Such a manhole is used for the inspection of the chamber 21. A muffler 38 is provided at the middle of the vent pipe 36. Reference numeral 39 designate support legs of the container 14.

A temperature sensor 40 (shown in FIG. 1) is secured to the top wall 18 to detect the internal temperature of the container 14. A suitable control device (not shown) is used to control the amount of the fuel (i.e., the combustion-improving gas) supplied to the burner 22 in response to the temperature information provided by the temperature sensor 40. This assures that the minimum amount of fuel required to operate the incinerator is supplied.

Referring to FIG. 3, a waste liquid supply line P1 connects between the atomizer pipe 30 and a waste liquid tank 42 to supply a waste liquid "W" in the tank 42 to the pipe 30. A pump 44 is provided to drive the waste liquid "W" through the supply line P1. Reference numeral 45 denotes a pressure gauge connected to the supply line P1, reference numeral 46 designates a solenoid valve, reference numeral 48 designates a strainer for removing foreign substance from the waste liquid "W", reference numeral 50 designates a flowmeter for measuring the flow rate of the waste liquid "W", and reference numerals 51*a* and 51*b* denote valves.

The waste gas supply line P2 connects between the burner 22 and the waste gas supply source 84 to supply a waste gas "EO" such as ethylene oxide or other waste gas from the waste gas supply source 84 to the burner 22 through the waste gas inlet 26*a*. Reference numeral 52 designates a pressure gauge for measuring the pressure of the waste gas, reference numeral 53 designates a union joint, reference numerals 54 and 56 denote solenoid valves, reference numeral 57 denotes a check valve, and reference numeral 58 designates a flashback arrester for arresting backfire.

The combustion-improving gas supply line P3 connects between the burner 22 and the combustion-improving gas supply source 86 to supply a combustion-improving gas "PG" such as propane or other combustible or self-sustained combustion gas from the combustion-improving gas supply source 86 to the burner 22 through the combustion-improving gas inlet 26*b*. Reference numeral 60 denotes a gas pressure switch for sensing the pressure of the combustion-improving gas "PG", reference numeral 62 denotes a pressure gauge for measuring the pressure of the combustion-improving gas "PG", the reference numeral 63 designates a union joint, reference numerals 64 and 66 denote solenoid valves, reference numeral 68 denotes a control valve for regulating the flow rate of the combustion-improving gas, reference numeral 70 designates a motor for driving the control valve 68, and reference numerals 71*a*, 71*b* and 71*c* designate valves.

The air supply line P4 connects between the burner 22 and the air supply source 72 such as a blower to supply combustion air "A" to the burner 22 through the combustion air inlet 28. Reference numeral 74 denotes an air pressure switch for sensing the air pressure, and reference numeral 76 denotes a damper for regulating the flow rate of the combustion air "A".

A gas branch line P5 diverges from the combustion-improving gas supply line P3 and meets at a gas mixer 78 a first air branch line P6 that branches from the air supply line P4. The combustion air "A" and the combustion-improving gas "PG" are mixed together at the pilot mixer 78, and then the mixed gas "PA" is supplied to a pilot burner 23 within the burner 22 to feed the pilot flame. Reference numeral 80 designates a solenoid valve connected to the gas branch line P5, and reference numeral 81 denotes a valve.

A second air branch line P7 diverges also from the air supply line P4 to supply the combustion air "A" to the protection air supply pipe 34. Reference numeral 82 is a valve connected to the second air branch line P7.

The waste gas "EO", the combustion-improving gas "PG" and the combustion air "A" are supplied to the burner 22 through the respective supply lines P2, P3 and P4, mixed together, lighted and jetted out in the form of flame. The flame jetted out of the burner 22 climbs the side wall 16 along a helical path on the inside surface 19 and forms a vortex of flame within the incineration chamber 21.

The waste liquid "W" is supplied to the atomizer pipe 30 through the waste liquid supply line P1 and sprayed into the chamber 21 through the spray nozzle 32 so that at least some of, and preferably most of, the sprayed waste liquid is jetted upwardly into the center of the vortex of flame. Meanwhile the air "A" supplied to the protection air supply pipe 34 through the second air branch line P7 blows on the spray nozzle 32 so that the spray nozzle 32 is cooled and thereby prevented from being excessively heated.

As described above, the waste liquid "W" is jetted upwardly from the bottom of the container 14 toward the top wall 18. This allows the atomized waste liquid to be heated by the burner flame during its upward and downward movement. Stated differently, the atomized liquid is heated both ways, i.e., one way on which it drives upwardly and the other way on which it falls downwardly. Thus, in the incinerating chamber 21, the waste liquid can be heated twice as much efficiently as it would be in a conventional incinerator wherein waste liquid is heated while falling only. Thus, the incinerator 12 requires a less bulky container as compared to such a conventional incinerator.

Heated both ways, the atomized liquid vaporizes at a high temperature within the chamber 21, allowing the complete incineration of the liquid. In this manner, the waste liquid is efficiently incinerated within the container 14 while less energy is consumed, which allows designing of a small-sized device that can perform incineration of a great amount of waste liquid. This results in substantial reduction of the equipment cost and the fuel cost.

It should be recognized that nitrogen oxide resulting from the incineration is substantially decreased in amount according to the invention because the burner flame temperature is lowered due to the sprayed waste liquid which drives through the vortex of flame.

It should be also recognized that the minimum fuel may be required to operate the incinerator of the invention since the temperature sensor 40 on top of the container 14 detects the internal temperature of the container 14 so that the detected temperature may be used to control the internal temperature.

As described above, the device and the method of the invention provide better heat efficiency to allow the design of a small-sized incineration container, allow quick heating and rapid vaporization of a waste liquid to encourage the complete incineration of the waste liquid, enable the incineration of a large amount of waste liquid in the small-sized container so that a less installation space is required, reduce the equipment cost, reduce the energy consumption due to the increase in heat efficiency, and assure a low flame temperature to inhibit formation of nitrogen oxide.

Figure 4:
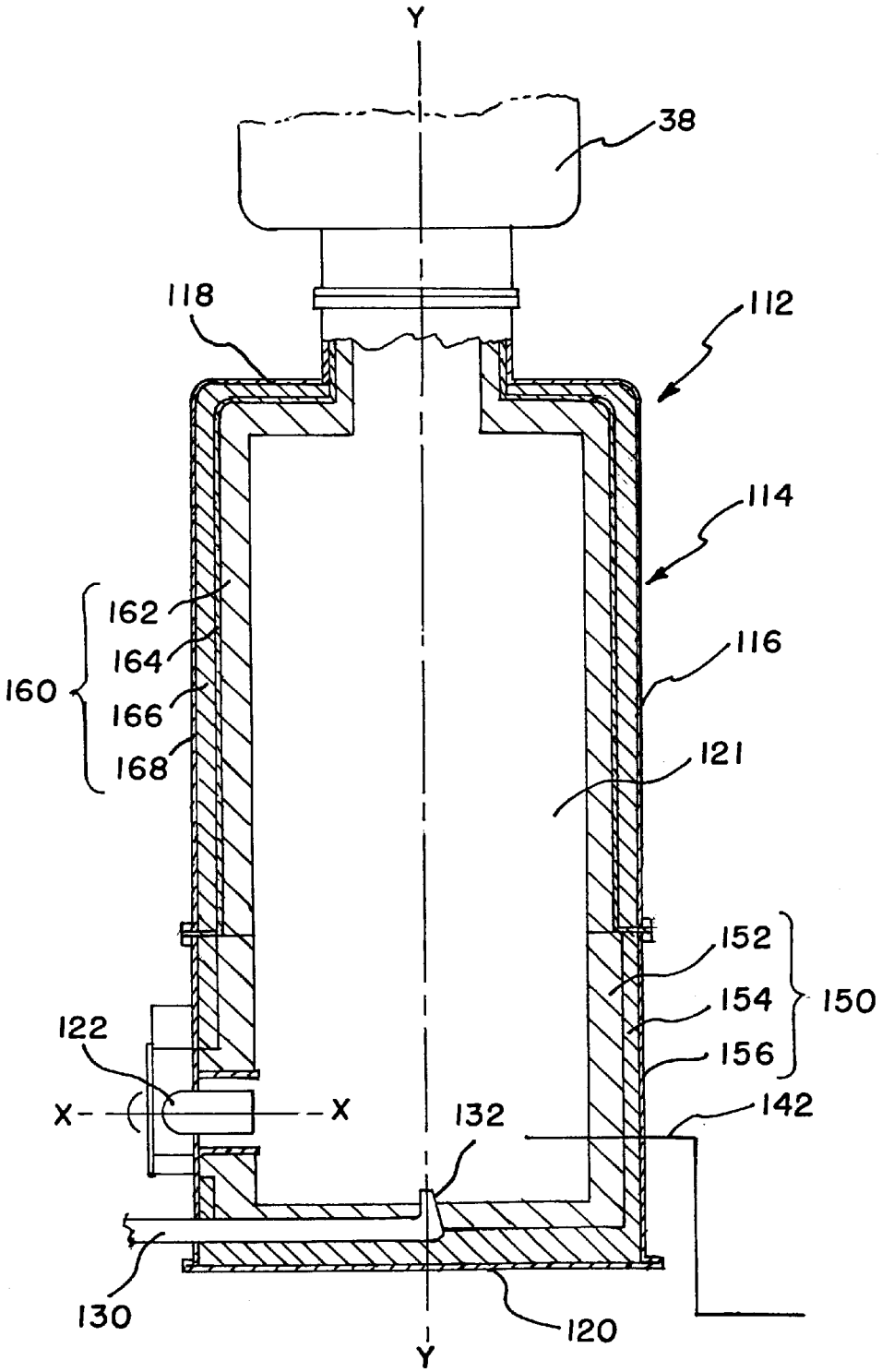
FIG. 4 is a schematic vertical cross section of a second embodiment of the present invention.
Figure 5:
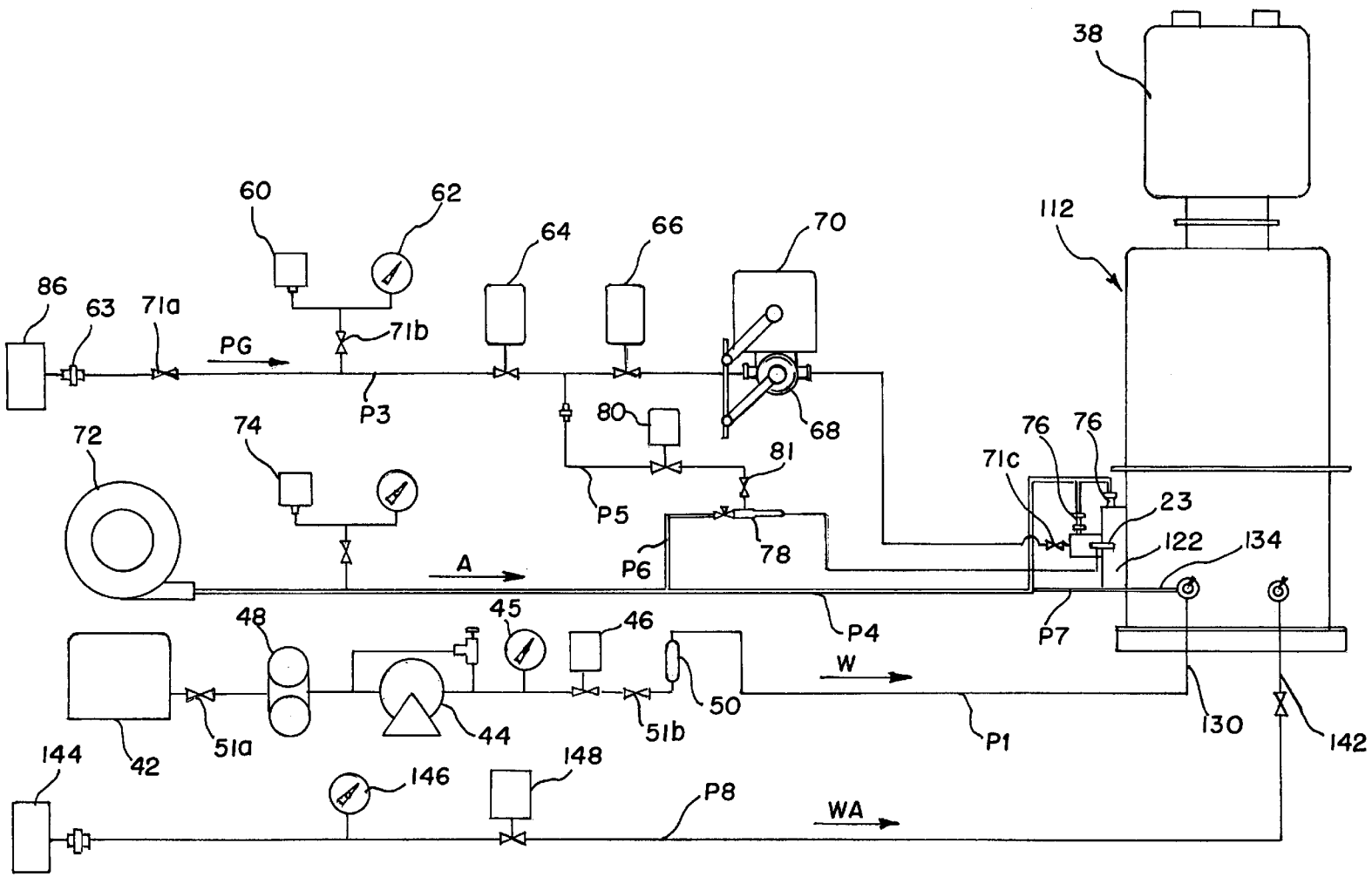
FIG. 5 is a schematic system diagram of the device in FIG. 4, showing the supply lines for and the flow directions of the waste liquid, the gas, the combustion air and the waste air, fed from the respective supply sources.

FIGS. 4 and 5 show another vertical incinerator according to the invention. The incinerator 112 is designed for incinerating a waste liquid together with waste air having an offensive odor. The incinerator 112 differs from that of the foregoing embodiment in that a waste air supply pipe 142

(shown in FIG. 5) is connected to the container 114 to feed waste air into the lower or combustion section of the incineration chamber 121. The pipe 142 passes through the lower part 150 of the side wall 116 which defines the combustion section of the incineration chamber 121. A waste air supply line P8 connects between the supply pipe 142 and a waste air supply source 144 to supply waste air "WA" to the incineration chamber 121. Reference numeral 146 denotes an air pressure gauge for measuring the air pressure of the waste air "WA", and reference numeral 148 denotes a solenoid valve. However, no waste gas supply line is provided for the device of this embodiment to supply a waste gas to the burner 122.

The incinerator 112 further differs from that of the first embodiment in that the atomizer pipe 130 passes through the lower part 150 of the side wall 116 and it is mostly embedded in the bottom wall 120. The forward end of the atomizer pipe 130 is formed into an upwardly directed spray nozzle 132 projecting upwardly into the chamber 121 so that the tube axis of the nozzle 132 is disposed substantially vertically in general alignment with the cylinder axis of the container 114. The protection air supply pipe 134 (shown in FIG. 5) may also be embedded in the bottom wall 120 so that it is disposed alongside the atomizer pipe 130.

In addition, the structure of the container is shown in more detail in FIG. 4 than in FIG. 1 although the containers by themselves in FIGS. 1 and 4 in fact have virtually the same structure. The lower part 150 of the side wall 116 has a triple-wall structure consisting of an innermost wall 152 of refractory cement, an intermediate wall 154 of insulating cement and an outermost wall 156 of stainless-clad steel. The bottom wall 120 also has the triple-wall structure. The upper part 160 of the side wall 116 that defines the upper or vaporization section of the chamber 121 has a quadruple-wall structure consisting of an innermost wall 162 of refractory insulating cement, an inner casing 164 of stainless steel, insulating wall 166 of ceramic fiber and an outer casing 168 of stainless-clad steel. The top wall 118 also has the quadruple-wall structure.

The other parts of the device of the second embodiment are virtually identical in structure to the first embodiment. Thus, the like reference numerals are used throughout the drawings to designate the corresponding parts, and descriptions of the corresponding parts are omitted in the description of FIGS. 4 and 5.

In the above second embodiment, the waste air is supplied to the chamber 121 and thus is incinerated together with the waste liquid. During the incineration, the odorcausing components of the waste air such as unsaturated organic compounds are oxidized and thereby the waste air can be free of the offensive odor before released into the atmosphere.

What is claimed is:

1. A method of incinerating a waste water comprising the steps of:

jetting a flame into a lower section of an incineration chamber having a vent adjacent to an upper section thereof, said chamber being defined by an upright cylindrical inside surface of a container, said jetting step comprising jetting said flame in a direction along a horizontal line tangent to said inside surface;

guiding said jetted flame along said inside surface so that said flame surrounds a cylinder axis of said cylindrical inside surface;

shooting an atomized waste water upwardly into said chamber so that at least some of said atomized waste water is directed upwardly along said cylinder axis to drive through said surrounding flame; and incinerating said atomized waste water as it drives through said surrounding flame, wherein said guiding step comprises guiding said flame circumferentially along said inside surface while attracting said flame toward said vent so that said flame climbs said container helically along said inside surface and forms within said chamber a vortex of said flame around a vertical axis, wherein said vertical axis is generally coincidental with said cylinder axis, and said shooting step comprises directing at least some of said atomized waste water upwardly through said vortex, wherein said jetting step comprises mixing a waste gas with a combustible gas and burning said waste gas and said combustible gas together to form said flame, and wherein said waste gas is ethylene oxide, said combustible gas is propane, and said waste water contains ethylene oxide.

2. A system for incinerating a waste water, comprising:

a container defining within said container an incineration chamber having upper and lower sections, said container having a vent adjacent to said upper section of said chamber, said container comprising an upright tubular side wall having a cylindrical inside surface defining said chamber and a bottom at a lower end of said side wall;

a burner connected to said container near said lower section to jet a flame into said chamber, said burner being held by said side wall such that said flame is jetted out of said burner in a direction along a horizontal line tangent to said inside surface of said side wall; and a waste water atomizer having an upwardly directed spray nozzle held by said bottom to shoot an atomized waste water upwardly into said chamber such that said waste water shot out of said spray nozzle is directed toward said upper section, wherein said spray nozzle is tubular and defines a tube axis, and said spray nozzle is directed such that said tube axis of said spray nozzle is disposed substantially vertically and in general alignment with a cylinder axis defined by said cylindrical inside surface, wherein said system further comprises a combustible gas supply source connected to said burner, a waste water supply source connected to said atomizer, a combustion air supply source connected to said burner, and a waste gas supply source connected to said burner, wherein a waste liquid supply line connects between said atomizer and said waste water supply source, a pump is connected to said waste liquid supply line to drive a waste water to said atomizer through said waste liquid supply line, and a strainer is connected to said waste liquid supply line to remove foreign substance from said waste water driven through said waste liquid supply line, wherein a waste gas supply line connects between said burner and said waste gas supply source, and a flashback arrester is connected to said waste gas supply line to arrest a backfire, wherein a combustible gas supply line connects between said burner and said combustible gas supply source, a control valve is connected to said combustible gas supply line to regulate a flow rate of a combustible gas in said combustible gas supply line, and a motor is connected to said control valve to drive said control valve, and wherein an air supply line connects between said burner and said air supply source, a gas branch line diverges from said combustible gas supply line and meets a first air branch line at a gas mixer, said first air branch line branching from said air supply line, and a mixed gas line connects between said gas mixer and said burner.

3. The system according to claim 2, wherein a second air branch line diverges from said air supply line and connected to a protection air supply pipe that is connected to said atomizer.

4. A method of incinerating a waste water comprising the steps of:

jetting a flame into a lower section of an incineration chamber having a vent adjacent to an upper section thereof;

shooting an atomized waste water upwardly into said lower section so that said atomized waste water is directed toward said upper section; and incinerating said atomized waste water as it passes through said jetted flame, wherein said jetting step comprises mixing a waste gas with a combustible gas and burning said waste gas and said combustible gas together to form said flame, said waste gas being ethylene oxide, said combustible gas being propane, and said waste water containing ethylene oxide.

5. The method according to claim 4, wherein said chamber is defined by an upright cylindrical inside surface of a container, and said jetting step comprises jetting said flame in a direction along a horizontal line tangent to said inside surface.

6. The method according to claim 5, further comprising guiding said jetted flame along said inside surface so that said flame surrounds a cylinder axis of said cylindrical inside surface.

7. The method according to claim 6, wherein said shooting step comprises directing at least some of said atomized waste water upwardly along said cylinder axis so that said some of said atomized waste water drives through said surrounding flame.

8. The method according to claim 6, wherein said guiding step comprises guiding said flame circumferentially along said inside surface while attracting said flame toward said vent so that said flame climbs said container helically along said inside surface and forms within said chamber a vortex of said flame around a vertical axis.

9. The method according to claim 8, wherein said vertical axis is generally coincidental with said cylinder axis, and said shooting step comprises directing at least some of said atomized waste water upwardly along said cylinder axis so that said some of said atomized waste water drives through said vortex.

* * * * *